United States Patent [19]

Wen et al.

[11] Patent Number: 4,969,928

[45] Date of Patent: Nov. 13, 1990

[54] COMBINED METHOD FOR SIMULTANEOUSLY DEWATERING AND RECONSTITUTING FINELY DIVIDED CARBONACEOUS MATERIAL

[75] Inventors: Wu-Wey Wen, Murrysville; Albert W. Deurbrouck, Pittsburgh, both of Pa.

[73] Assignee: The United States of America as represented by the United States Department of Energy, Washington, D.C.

[21] Appl. No.: 318,567

[22] Filed: Mar. 3, 1989

[51] Int. Cl.[5] ..... C10L 5/16

[52] U.S. Cl. ..... 44/568; 44/569; 44/572; 44/594; 44/626

[58] Field of Search ..... 44/15 B, 23, 621

[56] References Cited

U.S. PATENT DOCUMENTS

| | | | |
|---|---|---|---|
| 3,807,557 | 4/1974 | Miller | 209/166 |
| 4,294,584 | 10/1981 | Verschuur | 44/23 |
| 4,355,999 | 10/1982 | Masologites | 44/621 |
| 4,412,840 | 11/1983 | Goksel | 44/23 |
| 4,501,593 | 2/1985 | Paersch et al. | 44/23 |
| 4,615,712 | 10/1986 | Wen | 44/10 R |

OTHER PUBLICATIONS

V. P. Mehrotra et al., "Review of Oil Agglomeration Techniques for Processing of Fine Coals", Internat'l Journal of Mineral Processing, 11(1983), pp. 175–201.

Frank W. Theodore, "Oil Agglomeration for Fine Coal Recovery as Commercialized at Conoco/Consol", 4th Internat'l.

Symposium on Agglomeration, Jun. 2–5, 1985.

Wasson, "Coal Dust Reduction—An Evaluation of Chemical Additives and Application Methods", Proceedings of the Inst. for Briquetting and Agglomeration, vol. 20, Sep. 1987.

Wen et al., "In Situ Cake Hardening Process for Simultaneous Dewatering and Reconstitution of Fine Coal", Electric Power Research Institute, Jan. 1989.

Wen & Deurbrouck, "A New Strategy for Fine Coal Dewatering and reconstitution", International Filtration Conference on Filtration and Separation, Mar. 21–24, 1988.

*Primary Examiner*—Carl F. Dees

*Attorney, Agent, or Firm*—Hugh W. Glenn; Robert J. Fisher; William R. Moser

[57] ABSTRACT

A finely-divided carbonaceous material is dewatered and reconstituted in a combined process by adding a binding agent directly into slurry of finely divided material and dewatering the material to form a cake or consolidated piece which can be hardened by drying at ambient or elevated temperatures. Alternatively, the binder often in the form of a crusting agent is sprayed onto the surface of a moist cake prior to curing.

14 Claims, 7 Drawing Sheets

COMBINED METHOD FOR SIMULTANEOUSLY DEWATERING AND RECONSTITUTING FINELY DIVIDED CARBONACEOUS MATERIAL

CONTRACTUAL ORIGIN OF THE INVENTION

The U.S. Government has rights in this invention pursuant to the employer/employee relationship of the inventor to the U.S. Department of Energy at the Pittsburgh Energy Technology Center.

BACKGROUND OF THE INVENTION

This invention relates to the processing of finely divided carbonaceous materials to permit the recovery of a solid product. Typically, coal or other carbonaceous material is ground to fine particle size (less than 0.6 mm) prior to the removal of ash and sulfur containing minerals in processes such as cycloning and froth floatation. The resulting slurry is most economically dewatered by mechanical means but mechanical dewatering becomes less effective for ultrafine coal particles because of the high surface area.

Recent developments in coal cleaning require ultrafine particle size to take advantage of the increased liberation of mineral matter and pyrite. These processes produce ultrafine clean coal which is extremely difficult to dewater adequately. Consequently, difficult problems involving increased shipping costs, unwanted moisture, freezing and dilution of BTU content remain to be addressed.

Although thermal drying is an effective method of moisture reduction in finely divided materials, high energy costs may make it infeasible or uneconomical. In addition, a completely dried, finely divided product can introduce environmental problems in handling, transportation and storage including dust pollution, spontaneous combustion explosion and wind erosion.

One attempt to address these problems involves reconstitution of the finely divided carbonaceous material by pelletizing, briquetting or compaction. Representative techniques are disclosed in the assignee's commonly owned U.S. Pat. No. 4,615,712 to Wen.

Therefore, in view of the above, it is one object of the present invention to provide an improved process for the dewatering and reconstitution of finely divided carbonaceous material.

It is a further object of the present invention to provide a process for reconstituting carbonaceous material wherein dust emissions during transportation, handling and storage are ameliorated.

It is also an object of this invention to combine the dewatering, reconstitution and hardening of finely divided carbonaceous materials.

It is likewise an object to provide a process for producing dustless consolidated clumps of finely divided coal particles.

SUMMARY OF THE INVENTION

In accordance with the present invention, there is provided a combined process for dewatering and reconstituting finely divided carbonaceous material. The process involves adding a binding agent into a slurry of the carbonaceous material prior to conditioned and dewatered to form a cake or other consolidated intermediate which is cured into hardened, reconstituted particles of finely divided carbonaceous material.

In more specific aspects of the invention, the binding agent and slurry are conditioned by thorough mixing to form agglomerates of solids in the slurry. Where binders that are viscous liquids at ambient temperatures are selected, the slurry can be conditioned at ambient temperature. Where asphalt emulsion is selected, preferably the slurry also is heated to an elevated temperature to enhance the agglomeration of the finely divided particles. Consequently, the dewatering step is greatly enhanced. Advantageously, the consolidated intermediate is fragmented into random particle sizes to improve the bulk packing capability of the cured, reconstituted product. These fragments are cured by drying to increase hardness, remove additional moisture and form a dust-free product.

In one other aspect of the invention, a process for reconstituting finely divided carbonaceous materials involves mechanically dewatering a slurry to form a moist cake and applying a binding agent onto the outer surface layers of the cake. The cake is fragmented into consolidated particles of various sizes and cured by drying.

BRIEF DESCRIPTION OF THE DRAWINGS

The present invention is illustrated in the accompanying drawings wherein.

DETAILED DESCRIPTION OF THE PREFERRED EMBODIMENTS

Figure 1:
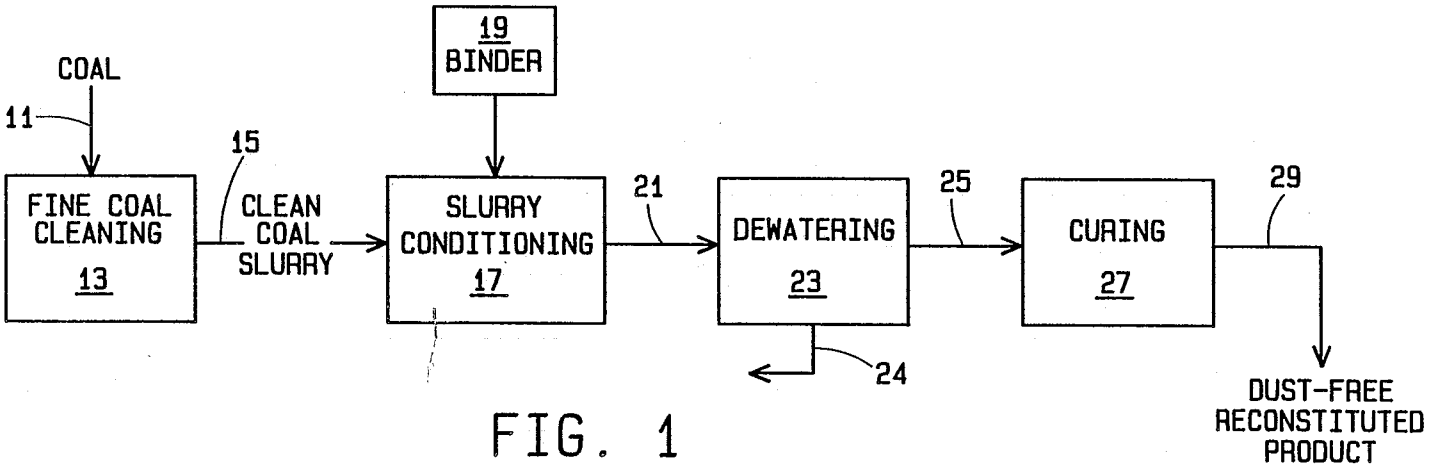
FIG. 1 is a diagrammatic view of a process for producing dust-free, reconstituted carbonaceous material.

One manner of carrying out the method of the present invention is illustrated in the diagram of FIG. 1. Coal or other carbonaceous material 11 is comminuted to fine particles sizes, e.g. below 28 mesh (0.6 mm particles size) in conjunction with a fine coal cleaning process 13. Fine coal cleaning such as the froth flotation process of U.S. Pat. No. 3,807,557 can be employed to produce a clean coal slurry 15 as indicated.

The resulting slurry of finely divided, clean carbonaceous material 15 is conditioned by mixing with a selected binder in step 17. Various binders, such as asphalt, asphalt emulsion and water, heating oil (particularly No. 6 heating oil), coal tar or pitch, molasses, humic acid and mixtures of compatable binders are contemplated. Of these, asphalt emulsions have been found to be the preferred choice based on effectiveness and cost, but important possibilities are contemplated with humic acid in acetone as binders.

Advantageously, the selected binder causes the finely divided particles to agglomerate together to assist in the subsequent filtering step. With binders which are viscous liquids at ambient temperatures, such as number 6 heating oil, coal tar or coal pitch, conditioning can be achieved by mixing, i.e. agitation or blending at ambient temperature. Where asphalt or asphalt emulsion is selected, the slurry can be heated to a temperature of between 50°-100° C., preferably 90°-95° C. to produce agglomerates and thereby assist in the dewatering step.

The conditioned slurry 21 with agglomerate particles is dewatered in a screening or filtering step 23. The filtrate or effluent 24 can be recycled to the fine coal cleaning process to recover portions of the binder and solid fines passing the filtering or screening medium.

The moist, dewatered carbonaceous material, illustrated as intermediate 25, advantageously is in the form of consolidated fragments or clumps of a convenient size for conveying and handling as a solid fuel. For example, particles of about 5-100 mm are contemplated. A random size distribution within this range is desirable to enhance bulk packing capability of the reconstituted product. The moist particles are cured at 27 typically by drying at ambient or elevated temperatures to produce a dust-free reconstituted product at 29.

The curing process can be conducted over an extended period of time, for instance, 24 hours or more by permitting the moist product to dry at ambient temperatures, for instance, 20°-25° C. Alternatively, heated dryers including ovens, gravity type, conveyor type or rotary drum dryers can be employed at temperatures well in excess of 30° C. for a more rapid curing process.

The inventors contemplate that various type of commercially available, dewatering devices can be selected. Of advantage are continuous cake filters, for instance, a disk type filter or a vacuum belt filter press, but other types of rotary drum filters with various scraper discharges or removable medium filters such as with a belt or roller discharge can be considered for use. A vacuum belt filter press is of advantage in that the filter cake can be compressed and consolidated between the opposing faces of dual belts passing through clearances between rollers. Filter cakes and consolidated intermediate product of 20-35% moisture by weight can be obtained prior to the curing step with these dewatering devices. On the other hand, disk and vacuum disk filters are advantageous due to the large filtering surface area that they provide.

Figure 2:
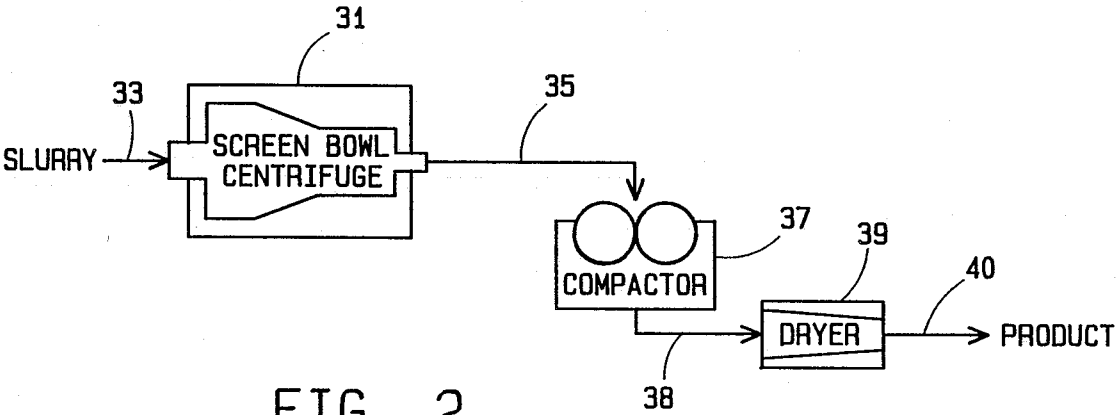
FIG. 2 is a diagrammatic view of an alternate step in the process of FIG. 1.

One other dewatering device is illustrated in FIG. 2. A screen bowl centrifuge 31 is fed with a conditioned slurry of finely divided clean coal 33 and a granular dewatered material 35 is forwarded to a compactor 37 to produce a consolidated intermediate 38 that can be cured in a dryer 39 to provide a dust-free reconstituted product 40.

Figure 3:
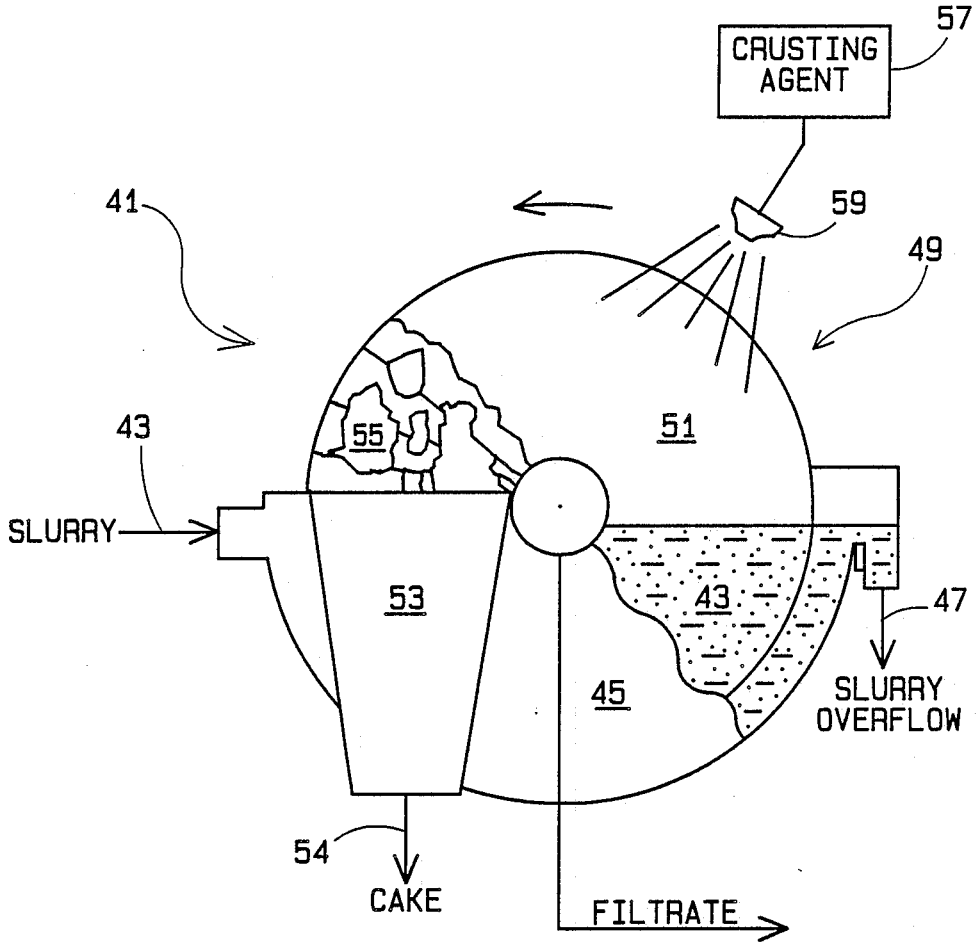
FIG. 3 is a schematic view of a vacuum disk filter for use in the process of the present invention.
Figure 4:
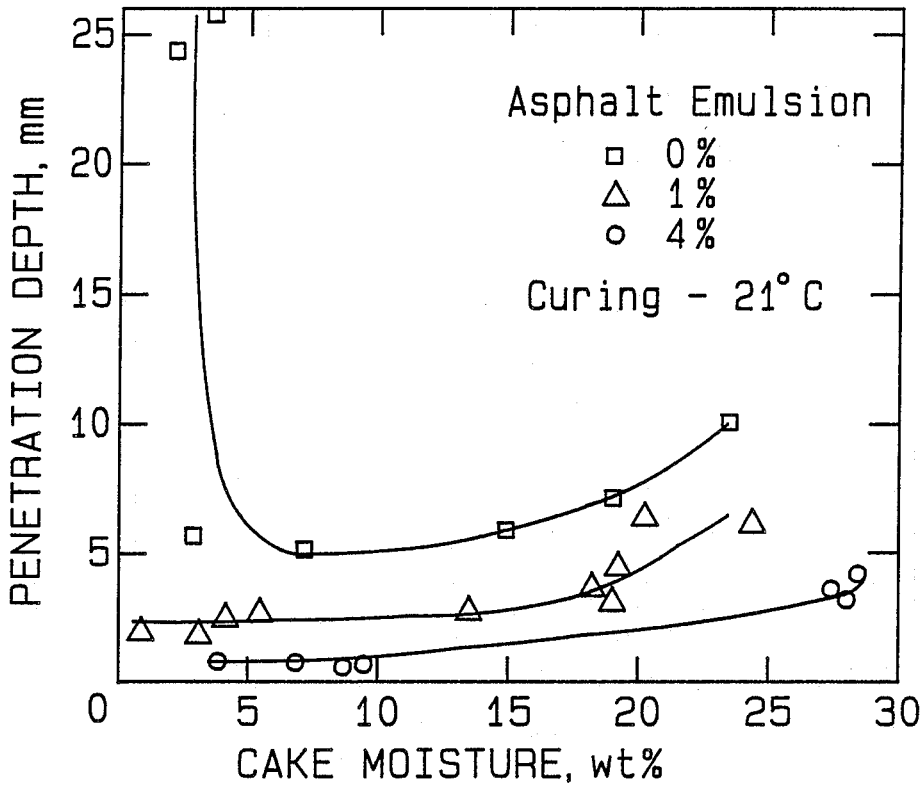
FIG. 4 is a graph showing cake strength (Penetration Depth) as a function of Cake Moisture with binder concentration (Asphalt Emulsion) parameters.
Figure 5:
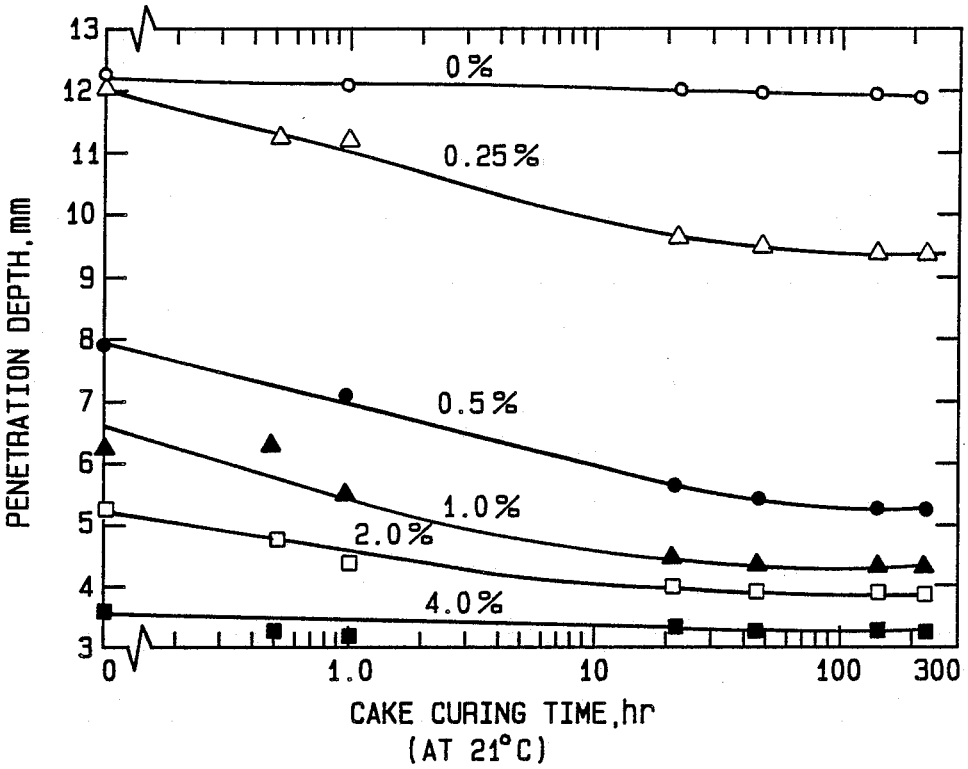
FIG. 5 is a graph showing cake strength as a function of curing time at various binder concentrations.

Another embodiment of the invention is illustrated in FIG. 3 where a vacuum disk filter apparatus 41 is shown as a dewatering device. The slurry of finely divided carbonaceous material 43 is fed into a semicircular trough 45 with its level controlled by an overflow 47. A plurality of vacuum filter disks 49 are supported to rotate within the slurry 43 and a filter cake 51 is deposited on the outer surfaces of the rotating filter disk 49. Advantageously separate troughs 45 for slurry can be provided for each of the filter disks 49.

A discharge hopper or trough 53 is positioned to receive clumps of filter cake 55 as they break away from the rotating cake. If needed a doctor blade or scraper (not shown) can be installed to facilitate removal of the moist filter cake as consolidated intermediate 54. The moist intermediate 54 can be cured at ambient or elevated temperatures as described above in conjunction with other embodiments of the invention.

In one manner of adding binder or a crusting agent 57, a spray nozzle 59 is positioned to spray the crusting agent onto the face surfaces of the filter cake 51 as it rotates prior to cake removal. The inventors have found that commercially available crusting agents such as those used for dust control, for example, Flowpro 1415 solution available from Betz Laboratories, can be used. Such crusting agents are blends of wetting and binding agents typically applied to inhibit fugitive emissions of fine particles from bulk material storage. Although, various crusting agents and other binders can be selected for use, asphalt emulsion binder is more advantageously used as an additive to the clean coal slurry rather than as a spray to the outer surfaces of a filter cake.

It will be understood that crusting agents and binders can be sprayed onto the outer surface of various other types of filter cakes than that of a rotary vacuum disk filter. Cakes such as those formed on rotary drum or compressive belt filters also can be treated in this manner.

The following examples are presented to illustrate but not to limit the invention as claimed below.

EXAMPLE I

Pittsburgh seam coal containing 3.9 wt % ash was crushed to the size distribution given in Table I below. All of the coal was ground to below 28 mesh (0.6 mm) and was formed into a slurry containing 20 wt % solids. An asphalt emulsion containing 60-70% asphalt in water with asphalt droplets of about 30 microns average diameter was added into the fine-coal slurry in sufficient amount to be 0.5 wt % of total solids. The slurry was dewatered to form a filter cake of about 2.5 cm thickness in a laboratory, vacuum filter apparatus and cured for about 10 hours at ambient temperature (21° C.). The strength of the reconstituted product was assessed by testing with a Koehler K19500 penetrometer equipped with a cone penetrator. The cone penetrator was allowed to rest on the product surface for 5 seconds and then locked in place. A gauge measured the penetration depth to one tenth of a millimeter. Comparative tests of this type were used to assess the strength of numerous laboratory cakes having different binders, binder concentrations, moisture concentrations and curing conditions. The results are shown in FIGS. 4-8.

TABLE 1

| Size Distribution of Pittsburgh Bed Coal | | | | |
|---|---|---|---|---|
| Size, Tyler Mesh | Wt % | Cummulative, Wt % | Ash, Wt % | Cummulative, Ash, Wt % |
| +28 | 0.6 | 0.6 | 5.1 | 5.1 |
| 28 × 48 | 30.6 | 31.2 | 3.9 | 3.9 |
| 48 × 100 | 24.0 | 55.2 | 3.8 | 3.9 |
| 100 × 200 | 19.9 | 75.1 | 3.8 | 3.6 |
| 200 × 325 | 8.7 | 83.8 | 3.7 | 3.6 |
| −325 | 16.2 | 100.0 | 4.3 | 3.9 |

EXAMPLE II

The procedure of Example I was followed except 1 wt % asphalt emulsion was added into the fine coal slurry and equivalent cake strength was obtained after only 0.3 hour curing time.

EXAMPLE III

Figure 6:
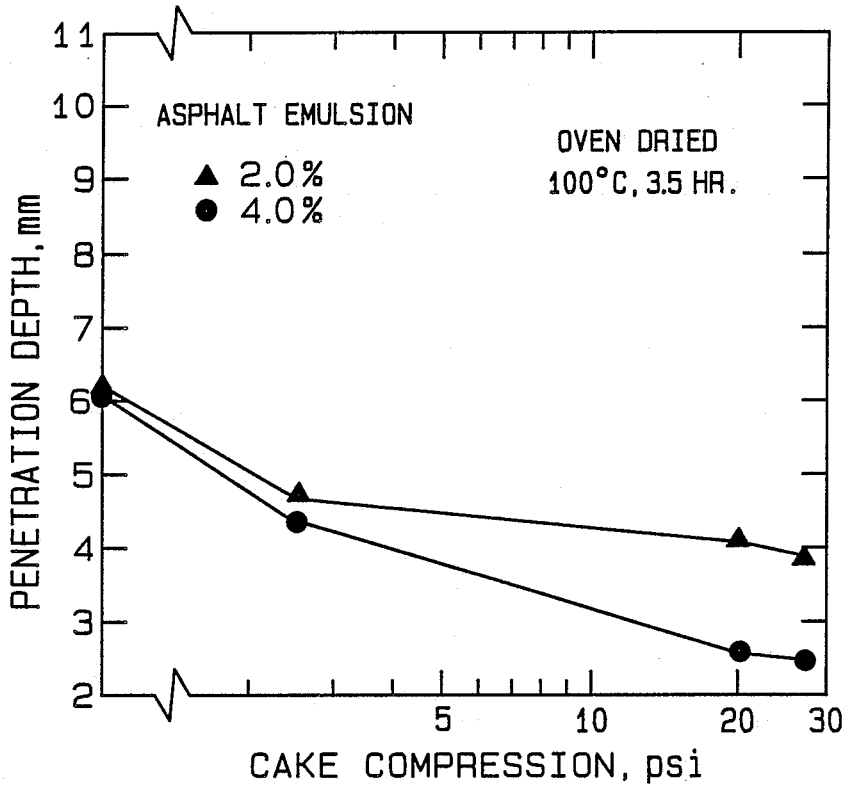
FIG. 6 is a graph showing cake strength as a function of cake compression.

A slurry of finely divided coal containing about 2 wt % asphalt emulsion was heated to about 90°-95° C. and filtered to form an about 3.2 cm thick filter cake with a vacuum laboratory-type filter apparatus. Several of these cakes were compressed at various poressures to simulate use of a vacuum-belt filter press. Cake strength was found to increase with increasing pressure up to about 30 psi. Additional filter cakes with 4 wt % asphalt emulsion were prepared for comparison and the results are illustrated in FIG. 6. The cakes were oven cured at about 100° C. for about 3.5 hours.

EXAMPLE IV

Figure 7:
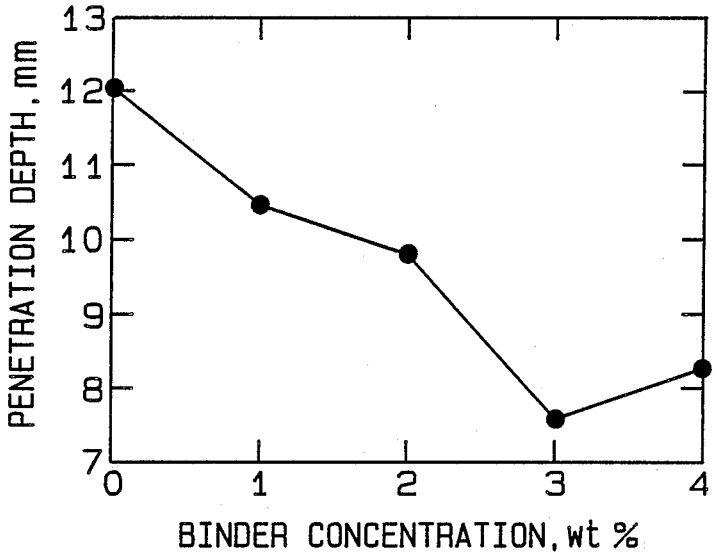
FIG. 7 is a graph showing cake strength as a function of binder concentration.
Figure 8:
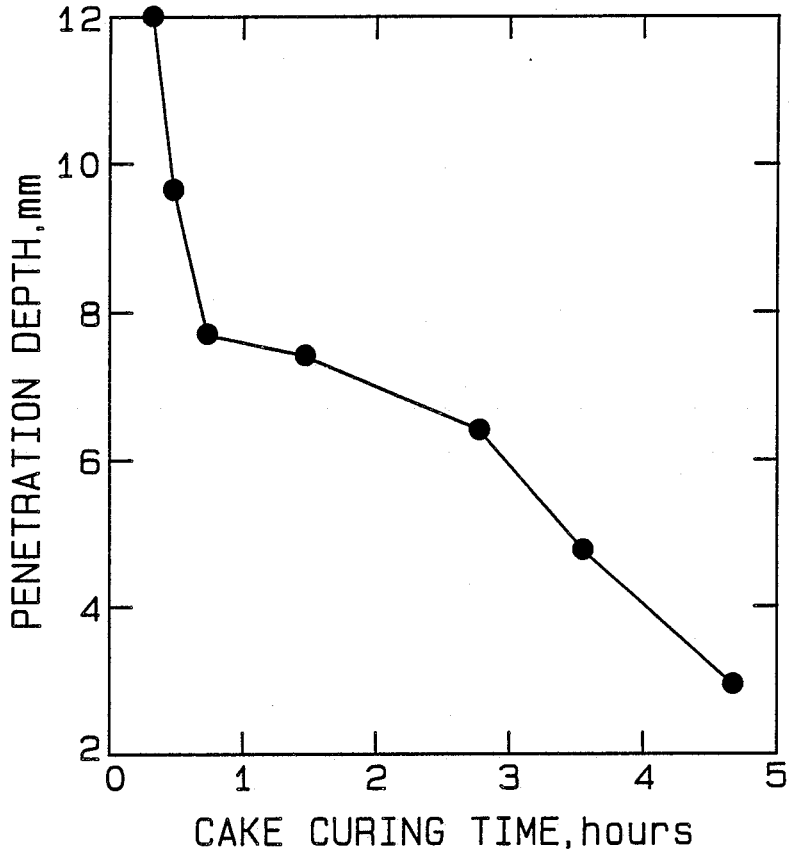
FIG. 8 is a graph showing cake strength as a function of curing time.

Small filter cakes prepared with a laboratory vacuum filter apparatus were sprayed with a crusting agent (Flow-pro 1415 solution) at various concentrations between 0–4 wt % of the cake solids weight. The cakes were oven cured at about 34° C. for up to about 5 hours. The results presented in FIG. 7 show that the cake strength increases with crusting agent concentrations up to about 3 wt %, with a slight decrease shown at the 4 wt % level possibly due to increased moisture content. FIG. 8 illustrates the increased cake strength with curing time at 34° C. It is expected that cake strength also would be improved by curing at ambient temperature (20°–25° C.) for somewhat longer periods of time.

It is therefore seen that the present invention provides a combined process for dewatering and reconstituting fine coal and other carbonaceous materials. It is particularly applicable after coal cleaning processes which require fine particle sizes. Advantageously, binders are added into the fine coal slurry prior to the dewatering operation to improve the cake strength. Various binder concentrations can be used. Asphalt emulsion can be added as binder at concentrations preferably of 1–4% by weight of the total solids. Alternatively, the binder or a crusting agent can be sprayed onto the outer surfaces of a cake prior to curing for added cake strength. It has been found that adding the binder to the slurry or cake substantially increases product strength and provides a dust-free carbonaceous fuel even at moisture contents of 4 wt % and below.

Although the present invention is described in terms of specific materials and process steps, it will be clear to one skilled in the art that various changes and modifications may be made in accord with the invention as defined in the accompanying claims.

The embodiment of the invention in which an exclusive property or privilege is claimed is defined as follows:

1. A combined process for dewatering and reconstituting finely divided carbonaceous material in slurry comprising:

adding a binding agent into a slurry of said carbonaceous material;

conditioning said slurry with binding agent to form solid agglomerates within the slurry;

dewatering said slurry to form an intermediate of moist, consolidated carbonaceous material; and curing said intermediate into hardened, reconstituted carbonaceous product.

2. The process according to claim 1 wherein the binding agent is an aqueous asphalt emulsion.

3. The process according to claim 2 wherein the slurry with asphalt emulsion binder agent is conditioned by heating to 90°–95° C.

4. The process according to claim 2 wherein the asphalt emulsion is added to the slurry in an amount sufficient to be 1–4% by weight of solids in the slurry.

5. The process according to claim 1 wherein the binding agent is selected from the group of viscous liquids consisting of number 6 heating oil, coal tar and coal pitch and wherein the slurry with the binding agent is conditioned at ambient temperature.

6. The process according to claim 1 wherein the consolidated intermediate material is fragmented into random particle sizes to provide bulk packing capability in the cured reconstituted material.

7. The process according to claim 6 wherein fragments in a size range of about 5 to 100 millimeters are formed for curing into hardened, reconstituted carbonaceous material.

8. The process according to claim 1 wherein said intermediate of consolidated carbonaceous material is cured to a moisture content of no more than 4 wt % to form a dust-free reconstituted product.

9. The process according to claim 1 wherein said intermediate is cured at ambient temperature to form a dust-free, reconstituted product.

10. The process according to claim 1 wherein said intermediate is cured by heating to a temperature above 30° C. for a sufficient time to increase the hardness of the reconstituted carbonaceous material.

11. The process according to claim 1 wherein said cake is formed by vacuum filtration and is fragmented to agglomerate particles prior to said curing.

12. A process for reconstituting finely divided carbonaceous material comprising:

providing a slurry of said carbonaceous materials;

mechanically dewatering said carbonaceous material to form a moist cake;

applying a binding agent onto said cake;

fragmenting said cake into consolidated particles of various sizes;

curing the consolidated particles at an elevated temperatures above 30° C.

13. The process of claim 12 wherein said slurry is provided of finely divided coal.

14. A process for dewatering and reconstituting finely divided coal in slurry comprising conditioning a slurry containing said coal by mixing with a binding agent, centrifuging the conditioned slurry onto the screen of a screen bowl centrifuge, removing the coal as granular dewatered material from the centrifuge, compacting the granular material into consolidated particles and curing the consolidated particles to provide a dust-free reconstituted product.

* * * * *